US005088311A

United States Patent [19]

Inoue

[11] Patent Number: 5,088,311

[45] Date of Patent: Feb. 18, 1992

[54] METHOD OF MAKING A TUBULAR MEMBER

[75] Inventor: Kiyoshi Inoue, Nagoya, Japan

[73] Assignee: NGK Spark Plug Co., Ltd., Nagoya, Japan

[21] Appl. No.: 746,177

[22] Filed: Aug. 15, 1991

Related U.S. Application Data

[63] Continuation of Ser. No. 541,673, Jun. 21, 1990, abandoned.

[30] Foreign Application Priority Data

| | | | |
|---|---|---|---|
| Jun. 21, 1989 | [JP] | Japan | 1-158823 |
| Jun. 21, 1989 | [JP] | Japan | 1-158824 |
| Apr. 24, 1990 | [JP] | Japan | 2-108227 |
| Apr. 26, 1990 | [JP] | Japan | 2-112927 |

[51] Int. Cl.[5] ..... B21K 21/08

[52] U.S. Cl. ..... 72/333; 72/356; 72/364

[58] Field of Search ..... 72/41, 333, 356, 364; 10/27 PH

[56] References Cited

U.S. PATENT DOCUMENTS

| | | | |
|---|---|---|---|
| 3,078,566 | 2/1963 | Egan | 72/356 |
| 3,186,209 | 6/1965 | Friedman | 72/356 |
| 3,765,218 | 10/1973 | Poulson et al. | 72/356 |
| 4,078,415 | 3/1978 | Koch et al. | 72/356 |
| 4,100,781 | 7/1978 | Zawacki et al. | 72/41 |

FOREIGN PATENT DOCUMENTS

| | | | |
|---|---|---|---|
| 2141654 | 1/1985 | United Kingdom | 72/356 |

*Primary Examiner*—Lowell A. Larson

*Attorney, Agent, or Firm*—Sughrue, Mion, Zinn, Macpeak & Seas

[57] ABSTRACT

In a method of making a metallic shell for a glow plug, a columnar blank is extruded to have an enlarged recess on the upper end surface of the blank so as to make an upper tubular portions, while extruded to have an enlarged recess on the lower end surface to make a first tubular end circular in section, an outer diameter of which is smaller than that of the upper tubular portion. The blank is transferred without inverting it, and the blank is reduced at its upper tubular portion to make a second tubular end hexagonal in section, an outer diameter of which is smaller than that of a middle portion of the blank, but greater than that of the first tubular end. Then, the blank is transferred without inverting it, and punched to communicate the first tubular end with the second tubular end by means of an axial bore. In other method, a mandrel is forced into the upper tubular portion to form a second tubular end hexagonal in section, an outer diameter of which is smaller than that of a middle portion of the blank, but greater than that of the first tubular end. In the forcing process, a cooling liquid oil is supplied between the upper tubular portion of the blank and the mandrel to alleviate friction heat, the cooling liquid oil flowing down between the upper tubular portion of the blank and the mandrel is led to the axial bore as an escape path of the liquid oil.

6 Claims, 9 Drawing Sheets

W1
102
101
103

W2
106
104
105
107

W3
110
108
109
111

W4
114
113
112
109
111

W5
115
113
112
109
111

W6
115
113
112
116
109
111

W4
112
113
114

METHOD OF MAKING A TUBULAR MEMBER

This is a Continuation of Application Ser. No. 07/541,673 filed June 21, 1990 now abandoned.

BACKGROUND OF THE INVENTION

1. Field of the Invention

This invention relates to a method of making a tubular member, and particularly concerns a metallic shell for an ignition plug, a glow plug, an oxygen concentration sensor, a water temperature sensor, and a knocking sensor.

2. Description of Prior Art

In a gasoline engine, an ignition plug is placed within a recess provided with a cylinder head of the engine. The ignition plug has a metallic shell which has a hexagonal portion, an outer diameter of which is smaller than that of a middle portion of the metallic shell.

One example of this metallic shell is disclosed in E.P. Publication No. 0036050 in which a blank is extruded to form a first tubular end circular in section, an outer diameter of which is smaller than that of a middle portion of the blank. Then, the blank is reduced at its upper tubular portion to make a second tubular end hexagonal in section, an outer diameter of which is smaller than that of a middle portion of the blank, but greater than that of the first tubular end. The blank is further transferred to next station in which the blank is reduced. During this transferring process, the blank is inverted upside down drawing in an arc with the blank held by fingers. During the inverting process, it is feared that the blank would collide on a die to do damage on the blank or the die which composes a cold extrusion machine.

Further, in the case in which the fingers moves the blank at a high speed, it is feared that the blank would fly out of the fingers by a centrifugal force.

In order to avoid this inconvenience, it is necessary to move the blank at such a speed that the fingers can continue to hold the blank, thus leading to a deteriorated production speed.

Therefore, it is an object of the invention to provide a method of making a tubular member which is capable of avoiding a damage by collision, and enhancing a transferring speed to lead to an improved production.

On the other hand, as shown in FIG. 22 and 23, a punch 210 is forced into a recess 201 of a blank 200 to extrude an upper tubular portion 202 hexagonal in section within an annular space 221 between a mandrel 220 and a vertical hole 231 of a die 230. During this process, a great amount of friction heat is generated between an inner wall of the recess 201 and an outer surface of the mandrel 220. In order to alleviate the friction heat, a cooling liquid oil supplied between the mandrel 220 and tubular portion 202. The fluid oil flowing between the recess 201 and the mandrel 220, however, is unable to find an escape path because the extrusion process is carried out before the blank is penetrated all through the length by a punching process. The fluid oil pressure exerted between the mandrel 220 and tubular portion 202 works to deform the inner wall of the tubular portion 202 to define an escaping passage or sink mark as designated, for example, by numeral 204 in FIG. 24 which is a sectional view taken along line A—A of FIG. 23.

This deformation of the tubular portion 202 causes to appear a shrinkage on a surface of the metallic shell so as to deteriorate an appearance of the shell which is regarded as an unacceptable product when a rear end of the shell is secured to an insulator of an ignition plug by means of caulking at an assemble process.

Therefore, it is another object of the invention to provide a method of making a tubular member which is capable of preventing the tubular member from being deformed due to a fluid pressure between a mandrel and an upper tubular portion of the tubular member.

SUMMARY OF THE INVENTION

According to the present invention, there is provided a method of making a tubular member comprising steps of; centering a vertical columnar solid blank, and making a recess at both upper and lower end surface of the blank by extrusion; extruding the blank to enlarge the recess on the upper end surface of the blank so as to make an upper tubular portions, while extruding to enlarge the recess on the lower end surface to make a first tubular end circular in section, an outer diameter of which is smaller than that of the upper tubular portion; transferring the blank without inverting the blank, and reducing the upper tubular portion to make a second tubular end hexagonal in section, an outer diameter of which is smaller than that of a middle portion of the blank, but greater than that of the first tubular end; and punching the blank transferred from the reducing process without inverting the blank so as to communicate the first tubular end with the second tubular end.

The blank is transferred from the extrusion process to the reducing process without inverting the blank, so that the blank is avoided from colliding on a die of an extrusion machine so as to protect the blank and the die against damage.

In association with an elimination of inverting the blank, there is no fear that the blank will fly out of the fingers even when the blank moves at a high speed at the transferring process, thus enabling a rapid transfer which leads to an improved production.

According to another method of making a tubular member comprising the steps of; centering a vertical columnar solid blank, and making a recess at both upper and lower end surface of the blank by extrusion; extruding the blank to enlarge the recess on the upper end surface of the blank so as to make an upper tubular portions, while extruding to enlarge the recess on the lower end surface to make a first tubular end circular in section, an outer diameter of which is smaller than that of the upper tubular portion; further extruding the upper tubular portion of the blank to make a stepped portion at an inner wall of the upper tubular portion; punching the blank transferred from the reducing process without inverting the blank so as to form an axial bore which communicates the first tubular end with the second tubular end; transferring the blank without inverting the blank, and reducing the upper tubular portion transferred from the punching process without inverting the blank to force a mandrel into the upper tubular portion so as to form a second tubular end hexagonal in section, an outer diameter of which is smaller than that of a middle portion of the blank, but greater than that of the first tubular end; and supplying a cooling liquid medium between the upper tubular portion of the blank and the mandrel to decrease an amount of friction heat caused from the reducing process, the cooling liquid medium flowing down between the upper tubular portion of the blank and the mandrel being led to the axial bore as an escape path of the liquid medium, whereby unnecessarily excessive pressure being prevented from being applied between the upper tubular portion of the blank and the mandrel.

The punching process is followed by the reducing process, so that during the reducing process in which the mandrel is forced into the upper tubular portion, the cooling fluid medium finds a path to escape to the axial bore which is provided with the blank in the punching process. This prevents an unnecessarily excessive pressure from being applied between the upper tubular portion of the blank and the mandrel, thus avoiding an inner wall of the tubular portion from being deformed. The elimination of the deformation prevents a shrinkage from appearing on a surface of a metallic shell when a rear end of the shell is secured to an insulator by means of caulking at the time of assembling an igniter plug.

Various other objects and advantages to be obtained by the present invention will be appeared in the following description and in the accompanying drawings.

DETAILED DESCRIPTION OF PREFERRED EMBODIMENTS

Figures 1, 2, 3, 4, 5, 6, 7:
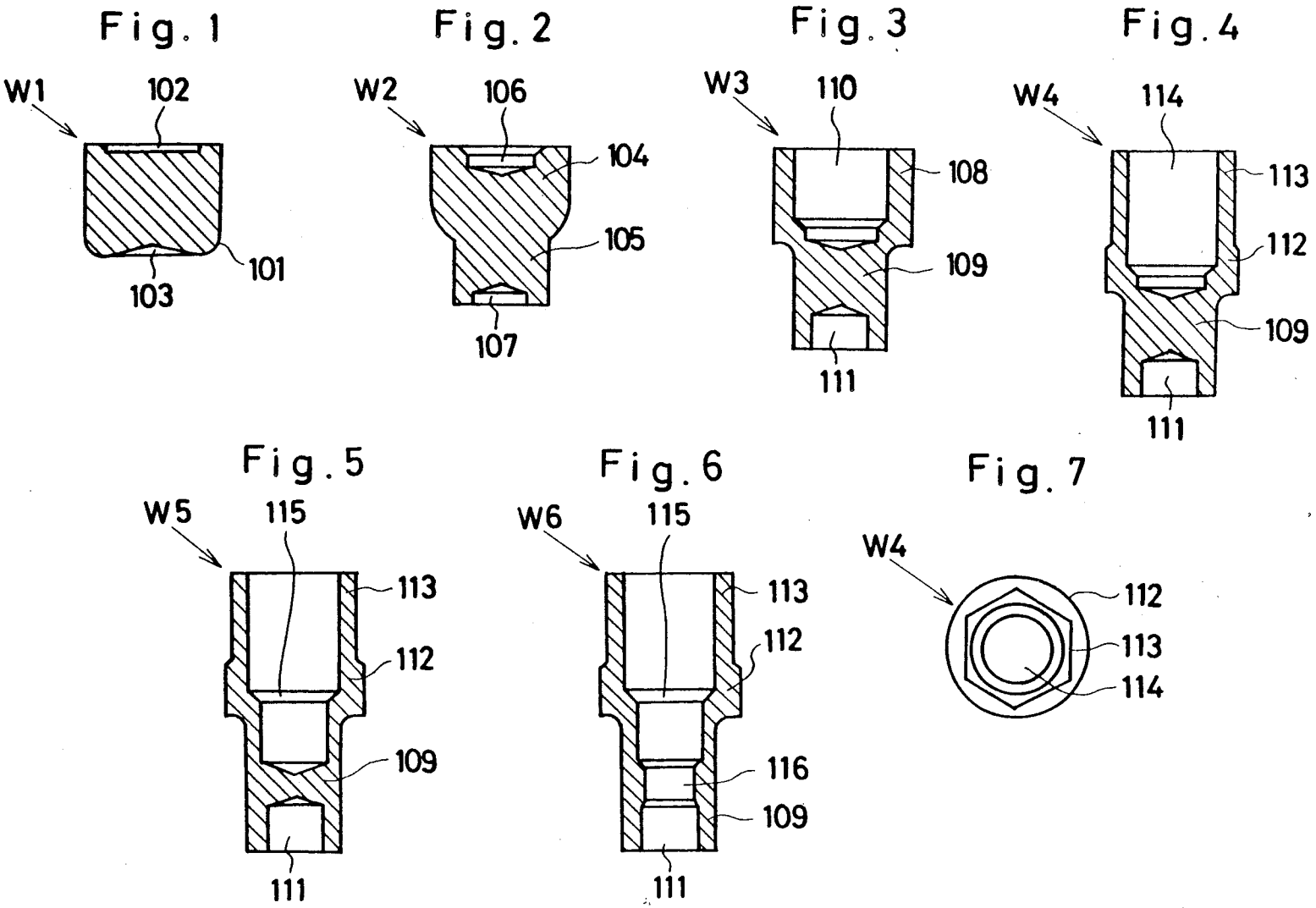
FIGS. 1 through 6 are cross sectional views in which a blank is processed by predetermined steps according to a first embodiment of the invention.
FIG. 7 is an upper plan view of FIG. 4.
Figure 9:
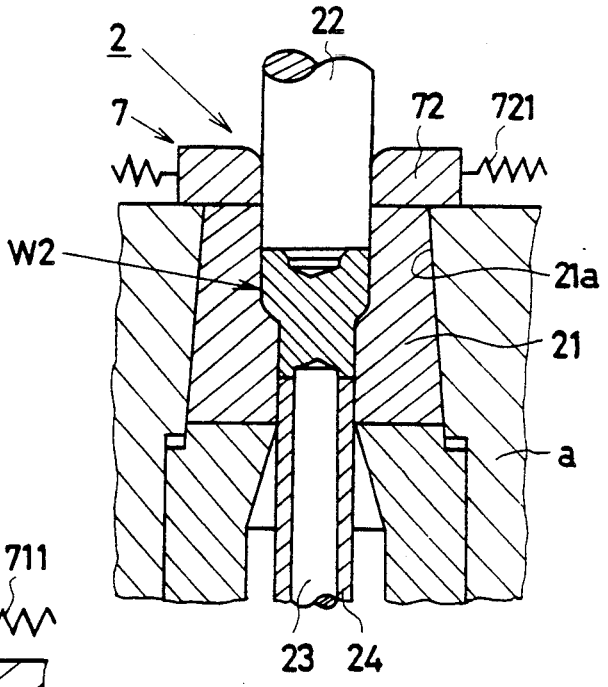
FIGS. 8 through 13 are cross sectional views showing an cold extrusion machine.
Figure 8:
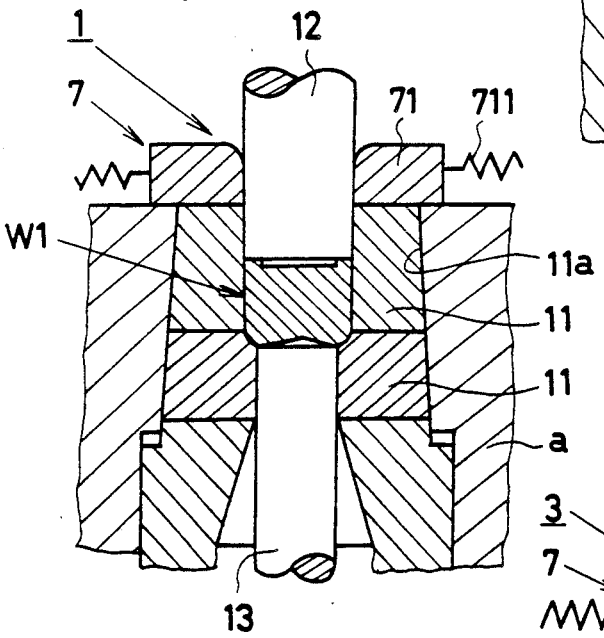
Figure 10:
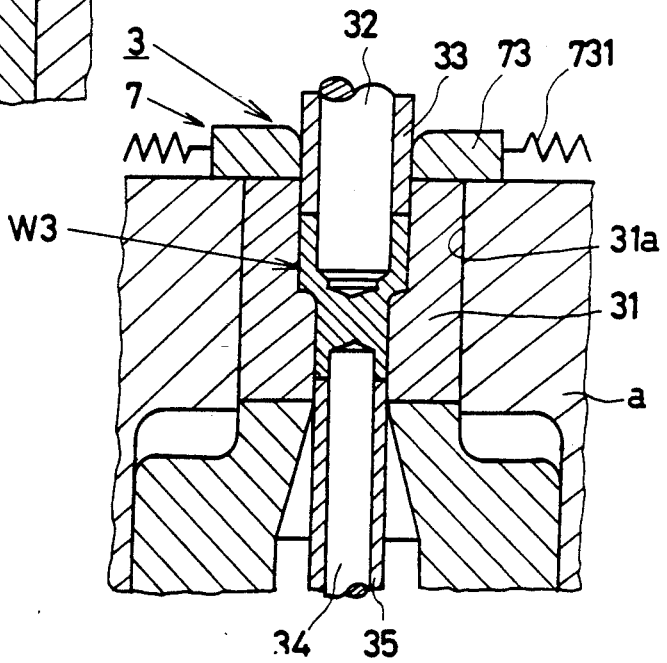

Referring to FIGS. 1 through 15, a first embodiment of the invention is described hereinafter with a tubular member incorporated into a spark plug as a metallic shell. A cold extrusion machine has forming stations 1 through 6, each of which includes a transferring means 7 as shown in FIGS. 8 through 13.

Figure 12:
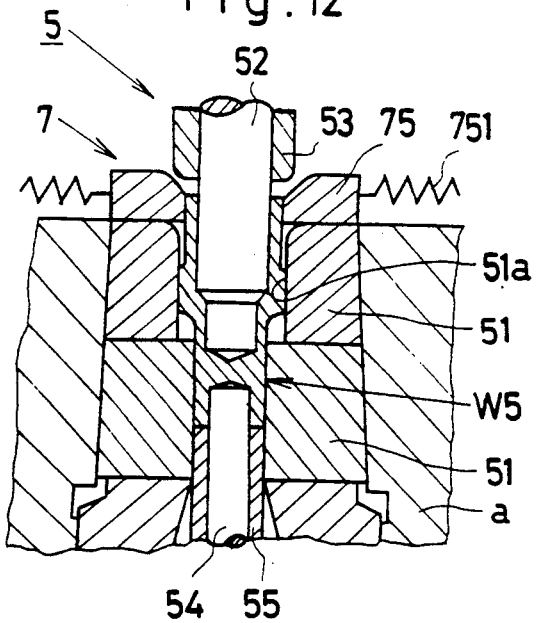
Figure 11:
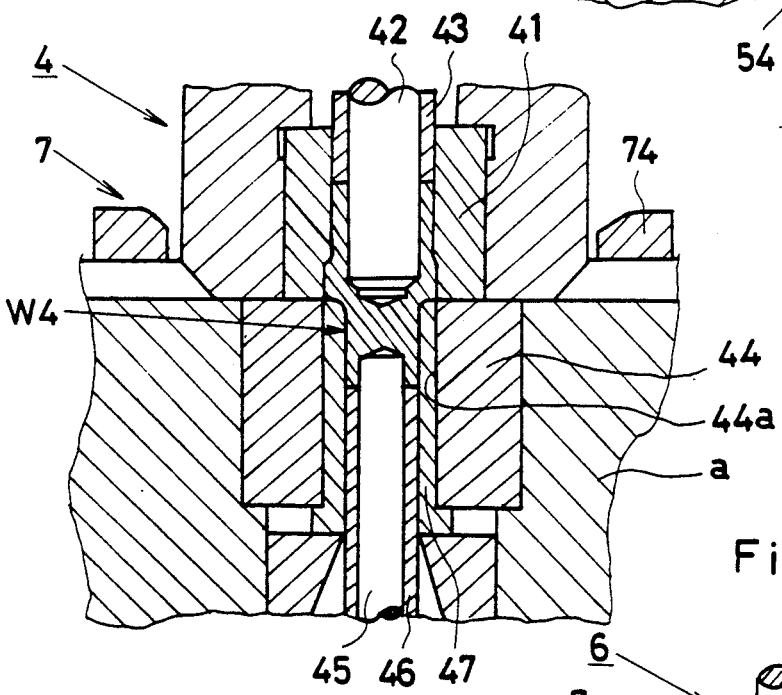
Figure 13:
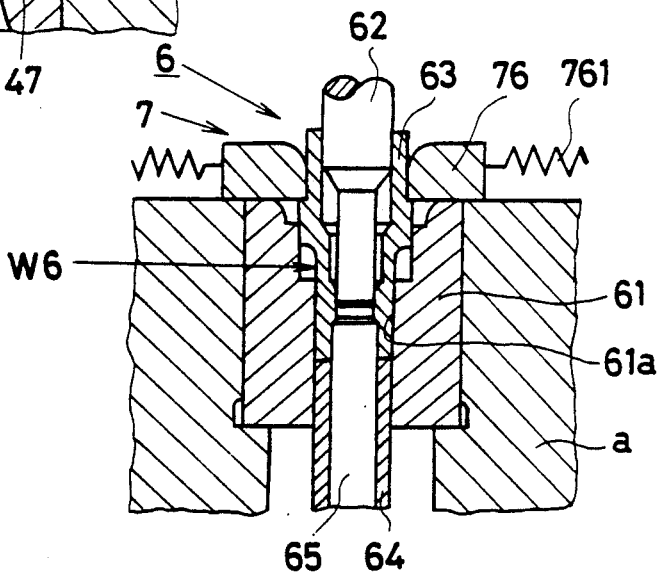

The first forming station 1 has a cylindrical mould die 11, a punch 12 and a kickout pin 13 in order to form a blank W1 by means of swaging as shown in FIG. 1. The second forming station 2 has a mould die 21, a punch 22, a pin 23 and a kickout sleeve 24 in order to form a blank W2 by means of a forward extrusion as shown in FIG. 2. At the first and second stations 1, 2, a centering of the blank is carried out for a subsequent forming station 3. The third forming station 3 has a mould die 31, a punch 32, a punch holder 33, a pin 34 and a kickout sleeve 35 to form a blank W3 by means of forward and backward extrusion as shown in FIG. 3. A fourth forming station 4 has a mould die 41, a punch 42, a kickout sleeve 43, an outer sleeve 44, a pin 45, a kickout sleeve 46 and a outer sleeve 47 to form a blank W4 as shown in FIGS. 4 and 5. As shown in FIG. 12, a fifth forming station 5 has a mould die 51, a punch 52, a stripper sleeve 53, a pin 54 and a kickout sleeve 55 in order to form a blank W5 as depicted by FIG. 5. A sixth forming station 6 has a mould die 61, a piercing punch 62, a stripper sleeve 63, a kickout sleeve 64 and a chip chute 65 in order to form a blank W6 by piercing all through its length as shown in FIG. 6.

In this instance, the mould dies 11, 21, 31, 41, 51, 61 and the outer sleeve 44 are incorporated into a stationary member (a) of the cold extrusion machine, while the punches 12, 22, 32, 42, 52, 62 and the die 41 are incorporated into a movable member of the cold extrusion machine. A transferring means has fingers 71 through 76, spring means 711, 721, 731, 751 and 761, and moving means (not shown) which is adapted to move the fingers 71 through 76 without inverting these fingers. The first finger 71 is adapted to move a columnar solid blank to a die recess 11*a* of the mould die 11 at the first forming station 1. The blank is adapted to be vertically held all through the forming processes. The second finger 72 is adapted to transfer the blank W1 to a die recess 21*a* of the mould die 21 at the second forming station 2. The third finger 73 is adapted to move the blank W2 to a die recess 31*a* of the mould die 31 at the third forming station 3. The fourth finger 74 is adapted to move the blank W3 to a die recess 44*a* of the outer sleeve 44 at the third forming station 4. The fifth finger 75 is adapted to move the blank W4 to a die recess 51*a* of the mould die 51 at the fifth forming station 5. The sixth finger 76 is adapted to move the blank W5 to a die recess 61*a* of the mould die 61 at the sixth forming station 6.

In operation, the columnar blank which is severed from a steel billet is generally horizontally transferred to the die recess 11*a* of the mould die 11 at the first forming station 1 by means of the first finger 71 without inverting the blank, and held at an entrance of the die recess 11*a*.

In association with the downward movement of the movable member in the cold extrusion machine, the punch 12 forces the blank into the die recess 11*a* of the mould die 11. In the first forming station 1, the die 11 imparts a rounded corner 101 to the blank, while the punch 12 and the kickout pin 13 provides upper and lower end surface of the blank with centering recesses 102, 103 respectively to form the blank W1 as shown in FIG. 1. Then, the movable member moves upward to be away from the stationary member (a). With the upward movement of the movable member, the punch 12 moves away from the blank W1, and the blank W1 is ejected from the die recess 11*a* by means of the kickout pin 13. The blank W1 is generally horizontally transferred to the die recess 21*a* of the mould die 21 at the second forming station 2 by means of the second finger 72 without inverting the blank W1, and held at an entrance of the die recess 21*a*. In association with the downward movement of the movable member in the cold forming machine, the punch 22 forces the blank W1 into the die recess 21*a* of the mould die 21. The die 21 imparts a diameter-increased portion 104 and a diameter-reduced portion 105 to an upper and lower portion of the blank W1, while the punch 22 and the pin 23 provides enlarged recesses 106, 107 at the upper and lower end surface of the blank W1 respectively to form it into the blank W2. Then, the movable member moves upward to be away from the stationary member (a). With the upward movement of the movable member, the punch 22 moves away from the blank W2, and the blank W2 is ejected from the die recess 21*a* by means of the kickout sleeve 24. The blank W2 is generally horizontally transferred to the die recess 31*a* of the mould die 31 at the third forming station 3 by means of the third finger 73 without inverting the blank W2, and held at an entrance of the die recess 31*a*. In association with the downward movement of the movable member in the cold extrusion machine, the punch 32 forces the blank W2 into the die recess 31*a* of the mould die 31 in an extrusion process. The die 31 imparts a first tubular end 109 to a lower portion of the blank W2. The first tubular end 109 is circular in section, an outer diameter of which is smaller than that of an upper tubular portion 108. The punch 32 and the pin 34 provides cylindrical cavities 110, 111 at the upper and lower end surface of the blank W2 respectively to form it into the blank W3 depicted in FIG. 3. The cavities 110, 111 are formed to be greater than the enlarged recesses 106, 107 in both diameter and depth. Then, the movable member moves upward to be away from the stationary member (a). With the upward movement of the movable member, the punch 32 moves away from the blank W3, and the blank W3 is ejected from the die recess 31*a* by means of the kickout sleeve 35. The blank W3 is generally horizontally transferred to the die recess 44*a* of the mould die 44 at the fourth forming station 4 by means of the fourth finger 74 without inverting the blank W3, and held at an entrance of the die recess 31*a* with the first tubular end 109 fit into the sleeve 47 and the upper tubular portion 108 fit into a die 41.

In association with the downward movement of the movable member in the cold extrusion machine, the punch 42 is forced into the cylindrical cavity 110 of the blank W3 by an urging force of a spring (not shown), while the die 41 engages with an upper end of the outer sleeve 44 to depress the sleeve 44. The outer sleeve 44 moves downward by a force of a spring (not shown) to reduce the upper tubular portion 108 of the blank W3 between the die 41 and the punch 42 to form an upper cavity 114 within the upper tubular portion 108, and at the same time, reducing the lower portion of the blank W3 between the pin 45 and the outer sleeve 47. In the above reducing process, the die 41 and the punch 42 provides a cylindrical middle portion 112 with the blank W3, and providing a second tubular end 113 hexagonal in section, an outer diameter of which is smaller than that of the middle portion 112 in order to form the blank W4.

Then, the movable member moves upward to be away from the stationary member (*a*). With the upward movement of the movable member, the punch 42 and the die 41 moves away from the the second tubular end 113 of the blank W4 by an action of the kickout sleeve 43, and the blank W4 is ejected outside from the recess 44*a* of the kickout sleeve 44 by means of the sleeve 46. Then, the blank W4 is generally horizontally transferred to the die recess 51*a* of the mould die 51 at the fifth forming station 5 by means of the fourth finger 75 without inverting the blank W4, and held at an entrance of the die recess 51*a*.

A downward movement of the movable member forces the punch 52 into the upper cavity 114 of the blank W4 to provide a stepped portion 115 with an inner wall of the second tubular end 113 of the blank W4 by an extrusion process in order to form the blank W5 as depicted by FIG. 5.

Then, the movable member moves upward to be away from the stationary member (a). With the upward movement of the movable member, the punch 52 moves away from the blank W5 by an action of the kickout sleeve 55 to eject the blank W5 outside from the recess 51*a* of the mould die 51 by means of the sleeve 55. And as a consequence, the blank W4 is generally horizontally transferred to the die recess 61*a* of the mould die 61 at the sixth forming station 6 by means of the sixth finger 76 without inverting the blank W5, and held at an entrance of the die recess 61*a*.

A downward movement of the movable member forces the punch 62 into the upper cavity 114 of the blank W5 to vertically communicate the cavity 114 with the cylindrical cavity 111 in order to provide an axial bore 116 which axially pierces all through the length of the blank W5 in the punching process. In this instance, an inner space of the kickout sleeve 64 serves as the chip chute 65, a chip appeared during the punching process is expelled outside by passing through the chip chute 65 to form the blank W6 as depicted in FIG. 6. Then, the movable member moves upward to be away from the stationary member (a). With the upward movement of the movable member, the punch 62 moves away from the blank W6 to eject the blank W6 outside from the recess 61*a* of the mould die 61 by means of the kickout sleeve 64.

With the making method thus far described, the blank is transferred from the preceding station to the subsequent station without inverting the blank, and therefore, the blank is prevented from colliding on the outer sleeve 44 or the dies 11, 21, 31, 41, 51, 61 to protect them against damages.

With the elimination of inverting the blank W3, the blank W3 is avoided from being flown out of the fingers due to a centrifugal force when the blank W3 is transferred from the third forming station 3 to the fourth forming station 4 at a high speed, thus enabling an improved production.

Figure 14:
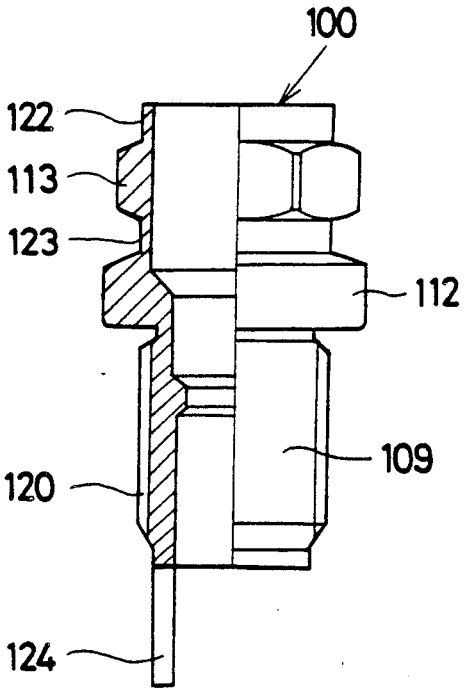
FIG. 14 is an elevational view of a metallic shell of a spark plug, but half of the metallic shell is sectioned.

As shown in FIG. 14, the blank W6, thus made, is provided a male thread 120 at an outer surface of the first tubular end 109. The second tubular end 113 is cut to have a circular portion 122 and a caulking groove 123 respectively to form a metallic shell 100, to a rear end of which an outer electrode 124 is secured by means of welding. A center electrode 81 and an insulator 82 are incorporated into the metallic shell 100 to form a spark plug 8 which is mounted on a cylinder head of a gasoline engine.

It is a matter of course that instead of the spark plug the metallic shell 100 may be employed to a glow plug, an oxygen concentration sensor, a water temperature sensor, a knocking sensor, a fuse type temperature sensor and a thermistor type temperature sensor.

It is also noted that it is only needed a cold extrusion machine which has the third forming station 3 and the fourth forming station 4.

Referring to FIGS. 16 through 21, a second embodiment of the invention is described hereinafter. In the second embodiment of the invention, a blank is identical to that of FIGS. 1 through 3, and forming stations are identical to those of FIGS. 8 through 10 in the first embodiment of the invention. Like reference numerals identical to those of FIGS. 1 through 3, and FIGS. 8 through 10 are those of FIGS. 16 through 21.

Figure 16:
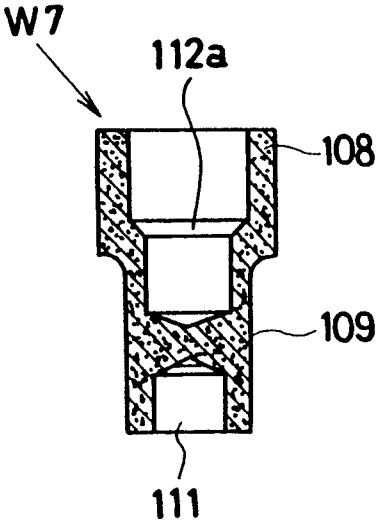

The blank is processed at the first and second forming stations 1, 2 in the same manner as described at the first embodiment of the invention. Without inverting the blank W3, the blank W3 processed by the third station 3 is horizontally transferred to an entrance of a recess 41c in which the die recess 41a of the mould die 41 is in communication with a die 41b at the fourth forming station 4, and held at the entrance of the recess 41c. A downward movement of the movable member forces a punch 42a into the upper tubular portion 108 so as to reduce the upper tubular portion 108 between the punch 42a and the die recess 41a, and at the same time, reducing the first tubular end 109 between the die 41b and the pin 43a by an extrusion. The extrusion provides the blank W3 with a stepped portion 112a at an inner wall of the upper tubular portion 108 to form it into a blank W7 as depicted in FIG. 16.

Then, the movable member moves upward to be away from the stationary member (a). With the upward movement of the movable member, the punch 42a moves away from the blank W7 to eject the blank W7 outside from the recess 41c by means of a kickout sleeve 44a.

Figure 20:
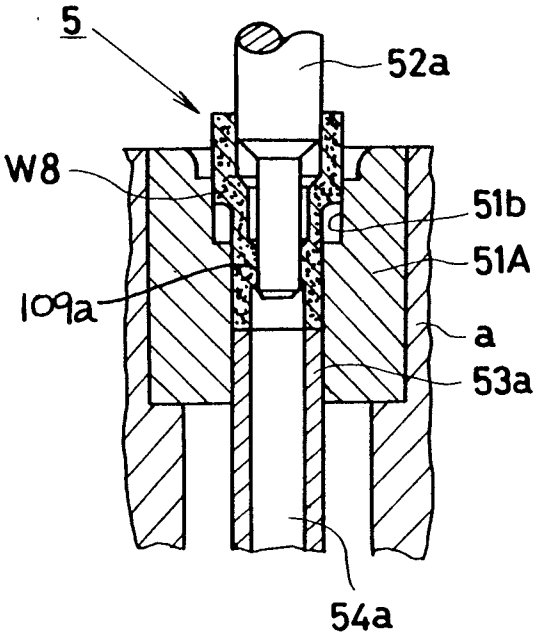
Figure 19:
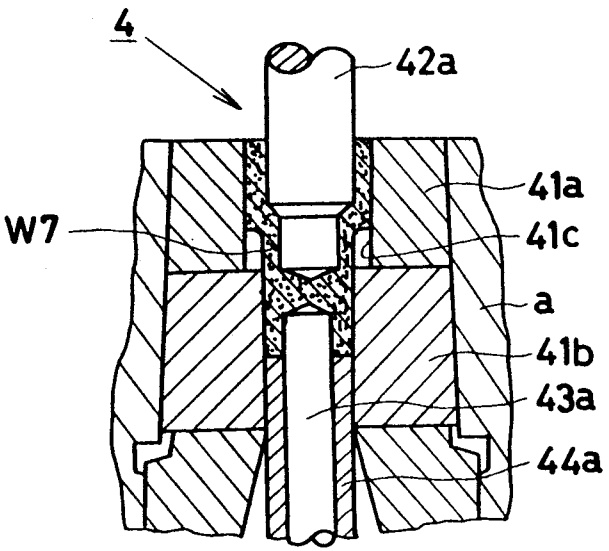

As shown in FIG. 20, a blank W8 is generally horizontally transferred to a die recess 51b of a mould die 51A at the fifth forming station 5 without inverting the blank W8, and held at an entrance of the die recess 51b.

Figure 17:
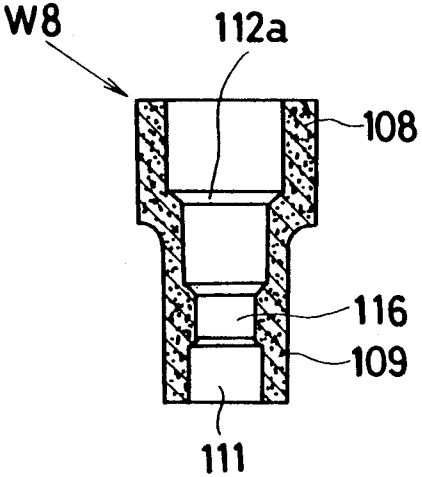

A downward movement of the movable member forces the punch 62 into the upper tubular portion 108 to reduce it at the recess 51b, and at the same time, communicating the tubular portion 108 with the first tubular end 109 in order to provide an axial bore 116 which axially pierces all through the length of the blank W8 in the punching process. During the punching process, however, a fringe portion 109a remains at an inner wall of the first tubular end 109. In this instance, an inner space of a kickout sleeve 53a serves as the chip chute 54a, a chip appeared during the punching process is expelled outside by passing through a chip chute 54a to form the blank W8 as depicted in FIG. 17. Then, the movable member moves upward to be away from the stationary member (a). With the upward movement of the movable member, the punch 52a moves away from the blank W8 to eject the blank W8 outside from the recess 51b by means of the kickout sleeve 53a.

Figure 21:
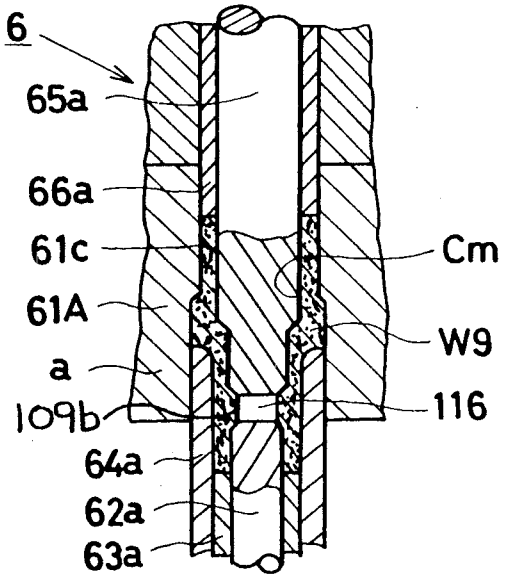
FIGS. 19 through 21 are cross sectional views in which a blank is processed in predetermined steps according to a second embodiment of the invention.

As shown in FIG. 21, a blank W9 is generally horizontally transferred to a die recess 61c of a mould die 61 at the sixth forming station 6 without inverting the blank W9, and held at an entrance of the die recess 61c.

Figure 18:
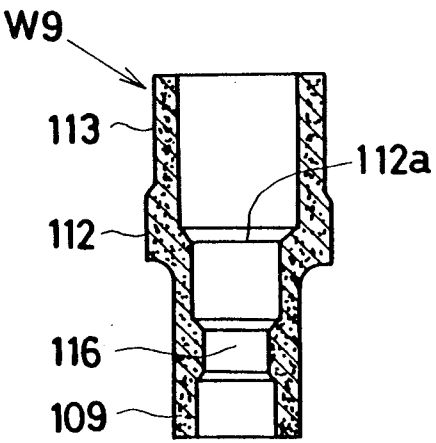
FIGS. 16 through 18 are cross sectional views in which a blank is processed in various steps according to a second embodiment of the invention.

A downward movement of the movable member forces a punch 62a into the first tubular end 109 to reduce it between the punch 62a and an outer sleeve 64a, and forcing a mandrel 65a into the upper tubular portion 108 to reduce it between the mandrel 65a and a mould die 61A so as to provide the second tubular end 113 hexagonal in section, an outer diameter of which is smaller than that of the middle portion 112. At the same time, each end of the mandrel 65a and the punch 62a press the fringe portion 109a to provide a tapered seat 109b on which the insulator is supported. This reducing process forms the blank W8 into the blank W9 as shown in FIG. 18.

Then, the movable member moves upward to be away from the stationary member (a). With the upward movement of the movable member, the punch 62a, a kickout sleeve 63a and the outer sleeve 64a moves away from the blank W9, so that a kickout sleeve 66a moves downward to eject the blank W9 outside from the recess 61c of the mould die 61A.

In the reducing process at the sixth forming station 6, a cooling liquid medium (Cm) such as liquid oil or cooling air is supplied between the mandrel 65a and the second tubular end 113 so as to lessen an amount of friction heat generated therebetween. The liquid oil (Cm) flowing down through between the mandrel 65a and the second tubular end 113 can find an escape path to the axial bore 116 because the axial bore 116 is made during the punching process which precedes the reducing process.

This prevents an unnecessarily excessive pressure from being applied between the second tubular end 113 and the mandrel 65a, and avoiding an inner wall of the second tubular end 113 from being deformed.

The elimination of the deformation prevents a shrinkage from appearing on the caulking groove 123 of the metallic shell 100 when the cylindrical middle portion 112 of the shell 100 is secured to the insulator 82 by means of caulking at the time of assembling a spark plug 8.

It is noted that at the sixth forming station 6, the punch 62a within the kickout sleeve 63a may be omitted for the convenience of treating the cooling liquid medium (Cm).

Figure 15:
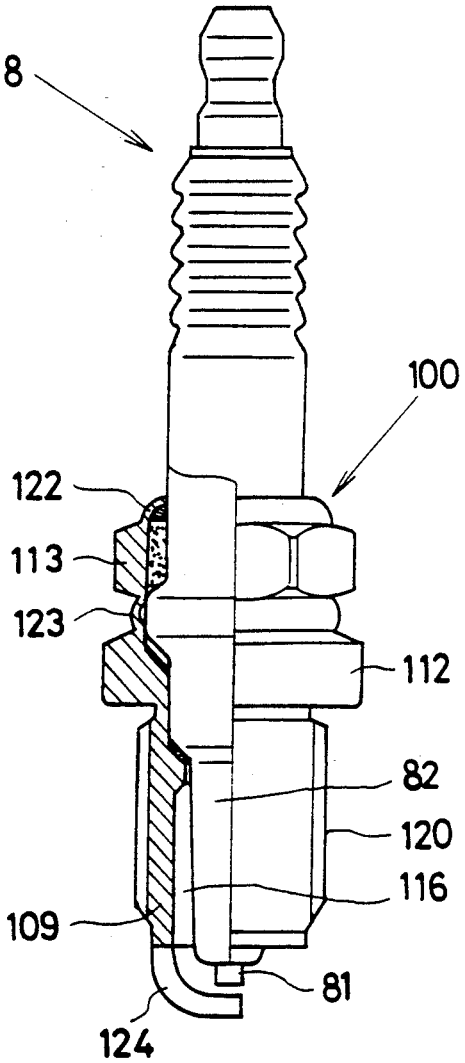
FIG. 15 is an elevational view of a spark plug, but partly sectioned.

The blank W9 is applied to the metallic shell 100 in the same manner as described by the first embodiment of the invention as shown in FIG. 14. Into the metallic shell 100, the center electrode 81 and the insulator 82 are incorporated to form the spark plug 8 as shown in FIG. 15.

It is noted the second tubular end 113 is made at the sixth forming station 6, however the second tubular end 113 may be formed at any time after the axial bore 116 was formed, that is, any cold extrusion machine is employed which has fifth and sixth forming stations 5, 6.

It is also appreciated that the extrusion direction by the fifth forming station 5 may be opposite relationship with that by the sixth forming station 6.

Figure 21A:
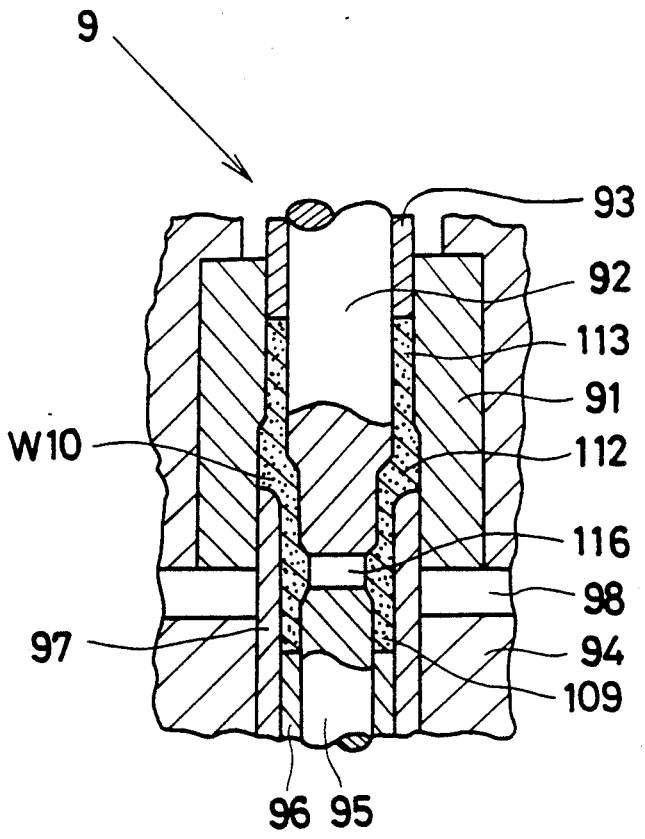
FIG. 21*a* is a view similar to FIG. 21 according to a third embodiment of the invention.
Figure 22:
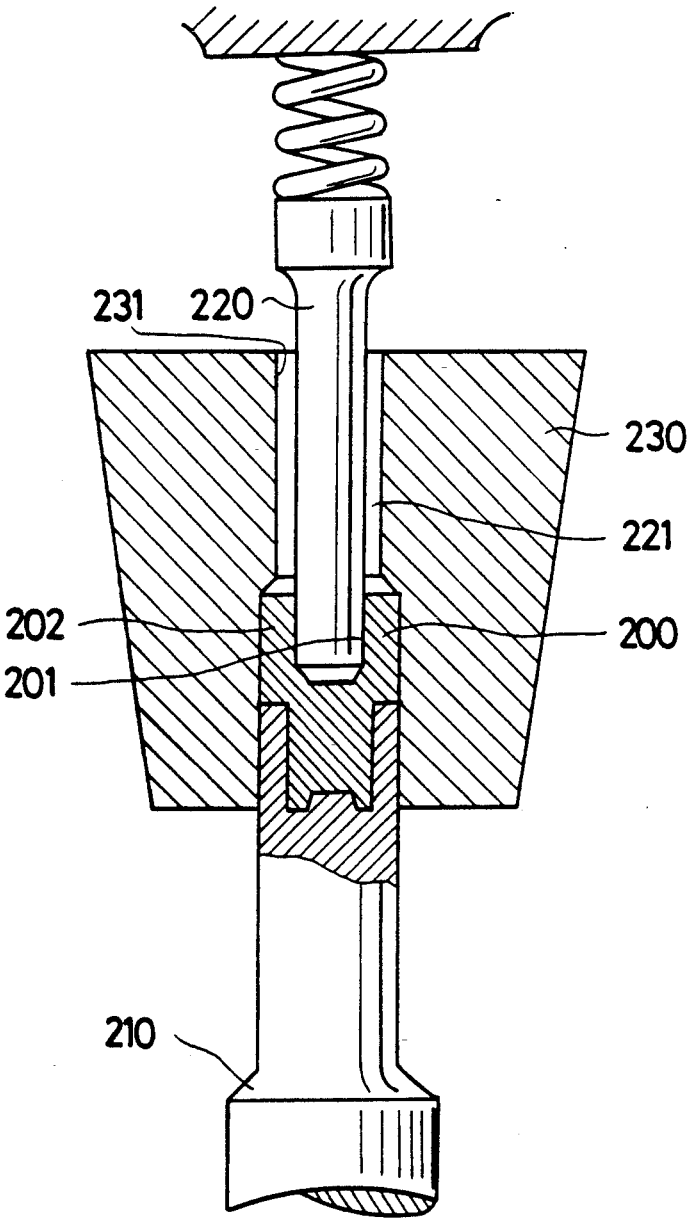
Fig. 22 PRIOR ART
FIGS. 22 and 23 are cross sectional views in which an extrusion machine is used by a prior art method of making a tubular member.
Figure 23:
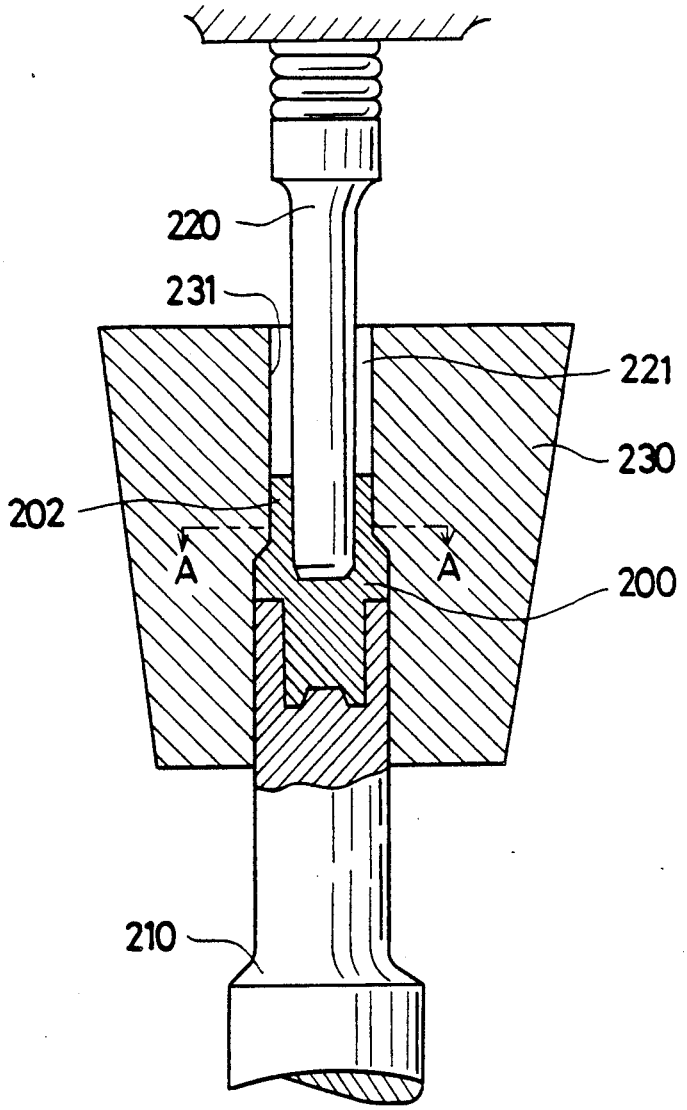
Fig. 23 PRIOR ART
Figure 24:
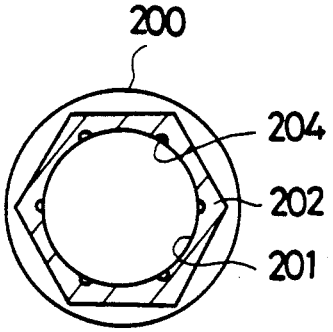
Fig. 24 PRIOR ART
FIG. 24 is a cross sectional view taken along line A—A of FIG. 23.

Referring to FIG. 21a in which a sixth forming station is modified according to a third embodiment of the invention, like reference numerals identical to those in FIG. 21a are those in FIG. 21.

The sixth forming station 9 of the cold extrusion machine has a first die 91, a mandrel 92, a kickout sleeve 93, a second die 94, a pin 95, a kickout sleeve 96 and an outer sleeve 97. In this instance, there is provided a space 98 between a lower end of the first die 91 and an upper end of the outer sleeve 97.

During an extrusion process, an upper end of the outer sleeve 97 comes across the space 98 to enter into an inner side of the first die 91 so as to overlap with the die 91. This prevent the blank W10 from partly flowing into the space 98 to avoid flashes from appearing on an outer surface of a blank W10 during reducing the second tubular end 113.

It is further noted that the pin 95 may be omitted in an aim to effectively work the axial bore 116 as is the case with the punch 62a shown in FIG. 21.

Various other modifications and changes may be made without departing the spirit and the scope of the following claims.

What is claimed is:

1. A method of making a tubular member comprising the steps of:

centering a vertical columnar solid blank, and making a recess at both upper and lower end surface of the blank by extrusion;

extruding the blank in a first die to enlarge the recess on the upper end surface of the blank so as to make an upper tubular portion, and simultaneously extruding said blank to enlarge the recess on the lower end surface to make a first tubular end circular in section, an outer diameter of which is smaller than that of the upper tubular portion;

further extruding the upper tubular portion of the blank to make a stepped portion at an inner wall of the upper tubular portion;

transferring the blank from the first die to a second die without inverting the blank and punching the blank in the second die so as to form an axial bore which communicates the first tubular end with the upper tubular portion, the punching process allowing a fringe portion to remain at an inner wall of the first tubular portion; and transferring the blank from the second die to a third die without inverting the blank, and forcing a mandrel into the upper tubular portion of the blank in the third die to reduce the blank so as to form a second tubular end hexagonal in section, and simultaneously forcing a punch into the first tubular portion to press the fringe portion by each end of the punch and the mandrel so as to provide a tapered seat, the second tubular end is diametrically smaller than that of a middle portion of the blank, but greater than that of the first tubular end.

2. In a method of making a tubular member as recited in claim 1, the tubular member is metallic shell defining an outer profile for a spark plug.

3. A method of making a tubular member comprising the steps of:

centering a vertical columnar solid blank, and making a recess at both upper and lower end surface of the blank by extrusion;

extruding the blank to enlarge the recess on the upper end surface of the blank so as to make an upper tubular portion, and simultaneously extruding said blank to enlarge the recess on the lower end surface to make a first tubular end circular in section, an outer diameter of which is smaller than that of the upper tubular portion;

further extruding the upper tubular portion of the blank to make a stepped portion at an inner wall of the upper tubular portion;

transferring the blank from the extruding process without inverting the blank and punching the blank so as to form an axial bore which communicates the first tubular end with the second tubular end, said punching process allowing a fringe portion to remain at an inner wall of the first tubular portion;

transferring the blank from said punching process without inverting the blank, and forcing a mandrel into the upper tubular portion of said blank causing said blank to be reduced so as to form a second tubular end hexagonal in section, and simultaneously forcing a punch into the first tubular portion to press the fringe portion with each end of the punch and the mandrel so as to provide a tapered seat, the second tubular end being diametrically smaller than that of a middle portion of the blank, but greater than that of the first tubular end; and supplying a cooling liquid medium between the upper tubular portion of the blank and the mandrel to decrease an amount of friction heat caused from the reducing process, the cooling liquid medium flowing down between the upper tubular portion of the blank and the mandrel being led to the axial bore as an escape path of the liquid medium, whereby unnecessarily excessive pressure is prevented from being applied between the upper tubular portion of the blank and the mandrel.

4. In a method of making a tubular member as recited in claim 3, the tubular member is metallic shell defining an outer profile for a spark plug.

5. In a method of making a tubular member as recited in claim 3, wherein the cooling liquid medium is oil, said oil being forced to flow between the upper tabular portion of the blank and the mandrel.

6. In a method of making a tubular member as recited in claim 3, wherein the cooling liquid medium is air, said air being forced to flow between the upper tubular portion of the blank and the mandrel.

* * * * *